United States Patent [19]

Kulitz

[11] Patent Number: 4,976,850

[45] Date of Patent: Dec. 11, 1990

[54] SUCTION APPARATUS

[75] Inventor: Guenter Kulitz, Ulm/Donau, Fed. Rep. of Germany

[73] Assignee: ESTA Apparatebau GmbH & Co. KG, Fed. Rep. of Germany

[21] Appl. No.: 224,796

[22] Filed: Jul. 26, 1988

[30] Foreign Application Priority Data

Jul. 30, 1987 [DE] Fed. Rep. of Germany ..... 3725204
Dec. 17, 1987 [EP] European Pat. Off. ..... 87118734

[51] Int. Cl.[5] ..... A47L 7/00

[52] U.S. Cl. ..... 210/104; 210/232; 210/241; 210/416.1; 15/353; 417/36; 417/38; 200/61.2

[58] Field of Search ..... 210/97, 104, 232, 241, 210/416.1; 15/321, 353; 200/83 A, 83 S, 61.2, 61.21; 417/36, 38, 313

[56] References Cited

U.S. PATENT DOCUMENTS

| | | | |
|---|---|---|---|
| 2,922,002 | 1/1960 | Gilman | 417/38 |
| 3,006,020 | 10/1961 | Fillery | 15/353 |
| 3,070,021 | 12/1962 | Tutthill | 417/38 |
| 3,154,652 | 10/1964 | Gilman | 417/38 |
| 3,162,737 | 12/1964 | Tutthill | 417/38 |
| 3,180,071 | 10/1966 | Nolte | 55/213 |
| 3,296,395 | 6/1968 | Fraser | 200/83 |
| 4,010,015 | 3/1977 | Brown | 15/353 |
| 4,080,104 | 3/1978 | Brown, Jr. | 417/40 |
| 4,268,288 | 5/1981 | Coombs | 15/353 |
| 4,631,374 | 12/1986 | Zoludow | 200/61.21 |
| 4,801,376 | 1/1989 | Kulitz | 210/241 |

FOREIGN PATENT DOCUMENTS

| | | |
|---|---|---|
| 0155502 | 9/1985 | European Pat. Off. . |
| 0187938 | 7/1986 | European Pat. Off. . |
| 2227935 | 12/1973 | Fed. Rep. of Germany . |
| 2835473 | 2/1980 | Fed. Rep. of Germany . |
| 3445200 | 6/1986 | Fed. Rep. of Germany . |
| 7706194 | 6/1977 | Netherlands . |

*Primary Examiner*—Richard V. Fisher
*Assistant Examiner*—Christopher Upton
*Attorney, Agent, or Firm*—Pravel, Gambrell, Hewitt, Kimball & Krieger

[57] ABSTRACT

In a suction apparatus (1) for sucking up wet and/or dry suction material there is a single suction chamber (6) having an approximately constant inside diameter over its entire height forming in the bottom region a preseparating chamber (9) for heavier parts and optionally liquid, as well as spaced above the same in the top area a filter chamber (10) for receiving a wet or a dry filter (11) for filtering before or after the preseparation. The main container (2) forming the suction chamber (6) and to be opened level with filter (11) is immediately adjacent to an electromotive exhauster unit (3) relative to which it can be tilted for emptying the preseparation chamber (9). So that the filter (11) is not subject to liquid or heavier parts to be preseparated, there is an adjustable fill level limiting device (25) with a limit switch (26) directly responding to the suction material, which switches off when the exhauster unit (3) responds and then automatically switches in again.

28 Claims, 9 Drawing Sheets

SUCTION APPARATUS

BACKGROUND OF THE INVENTION

The invention relates to a suction apparatus with a suction chamber and a suction inlet, as well as a suction outlet and provided for e.g. vacuum cleaning of wet suction material.

Such suction apparatuses are used for the most varied purposes, e.g. for cleaning swimming pool water, for sucking up moisture-containing dirt, as a decontaminate suction means as used by the fire brigade, etc. Independently of the inflow or the taking up of the suction material, there is a need to be able to derive a control signal which can control the operation of the suction apparatus. If a separation chamber is provided said control signal is suitable for e.g. controlling the filling level, so as to ensure that no further suction material is taken up when the separator is already adequately filled and must therefore be emptied before taking up further material. Pneumatic or similar level controls or protective circuits have not proved adequate for this purpose, particularly as they are complicated in construction and consequently fault-prone, whilst involving high costs.

SUMMARY OF THE INVENTION

The present invention is concerned with the problem of providing a wet suction apparatus or a suction device of the aforementioned type which, in a simple construction makes it possible to derive a control signal from the suction material taken up, so as to be able to control the operation of the suction device, an indicating device or the like.

In the case of a wet suction apparatus of the aforementioned type, this problem is inventively solved in that for supplying or producing the control signal a diaphragm or membrane switch mounted on the suction material is provided and responds directly thereto. Thus, a diaphragm or membrane is exposed to the suction material in such a way that for producing a switching operation it is subject to the action of the suction material. It is conceivable to use said switch or diaphragm in an area of a duct through which the suction material flows for limiting the flow quantity, in a separation chamber for limiting the fill level, upstream of a suction air port for protecting against the penetration of liquid or solid particulate suction material or the like.

In all cases it is advantageous if the diaphragm switch has a switch casing which is sealed in a substantially liquid-tight manner with respect to the suction material and having an e.g. frontal switching diaphragm. If the diaphragm does not respond to air pressure differences, i.e. not to pneumatic loading and instead responds to a direct mechanical pressure loading, then the switch casing is appropriately connected to a pressure compensating means, which e.g. ensures that the switch casing has essentially the same pressure as the suction chamber. The suction chamber can be formed by an intermediate portion of a duct.

It is particularly advantageous if the switch is continuously variable in connection with its response sensitivity, so that in the case of a predetermined fitting position it is on the one hand adapted to the desired operating conditions and on the other the same switch can be installed for different uses.

The switching element controlled by the diaphragm switch diaphragm is preferably an electrical switching contact, e.g. a microswitch, so that a very simple construction is obtained and an electric signal is available as the control signal. The switching element is advantageously directly operated within the switch casing by means of a spring-loaded switching rod.

A particularly advantageous further development of the invention comprises the diaphragm switch as a closing switch and cutout switch being positioned directly in a switching circuit. As a result the control signal and the associated control process are only produced if the limit value to be detected with the switch is reached or exceeded. On dropping below the same said control process is automatically cancelled out again without the operator having to manually carry out a separate switching operation. For example the switch can be located in the switching circuit of the suction apparatus drive, so that in this case the supply of the control signal is switched off and after relieving the switch diaphragm by the suction material is automatically switched on again. However, it is also conceivable to connect a valve, e.g. a valve flap to the switch for interrupting the suction process or for bringing about the filling of the separator.

In the case of a separating chamber the switch can in particularly advantageous manner be used as a fill level limiting device in that on reaching the predetermined fill level it switches off a suction fan or blower unit, particularly the motor thereof, via a motor protection switch.

With regards to its operating position, the switch is appropriately stepwise or continuously adjustable, so that it responds at different limit values. In the case of fill level limitation the switch can be positionally variably arranged with regards to the fill level.

As a function of the requirements the diaphragm can be positioned upright, namely vertical or downwardly or upwardly inclined, substantially completely upwardly directed or positioned at the top, or in substantially downwardly directed or bottom positioned manner. Particularly in the case of fill level control preference is given to an upright position of the diaphragm close to or in a boundary wall of the separating chamber. If the switch is used in the manner of or in place of a float valve for an air suction port the diaphragm is preferably positioned horizontally at the bottom or on an underside of the switch casing and the diaphragm or switch casing can simultaneously form a splash plate in front of or below the suction port which protects the latter against spray. The switch is designed so as to be completely immersible in the suction material liquid or the collected solid particle suction material, so that in the case of a correspondingly set response sensitivity the control signal is only produced when the switch is already substantially completely within said material.

In the case of a suction device of the above-described or similar type, the invention also proposes to subdivide the suction chamber into at least two longitudinal chamber segments, which are detachably or interchangeably fixed to one another. In the case of its use, each chamber segment forms an associated longitudinal portion of the suction chamber, so that the size thereof can e.g. be adapted to the particular requirements. In addition, the chamber segments can be provided with different equipment which is reciprocally interchangeable, e.g. with or without diaphragm switches, with or without submersible pumps, with or without a suction connection and the like, which permits the simple re-equipment of the wet suction apparatus in accordance with the particular requirement. This also permits a modular construction. Advantageously the intermediate ring, although conceivable, does not have a base, so that it can be arranged above the base of the suction chamber in any random segmental plane.

The suction chamber and the intermediate ring or the intermediate rings as such appropriately have substantially the same cross-sections at right angles to the longitudinal axis thereof and preferably circular cross-sections, so that they are matched in substantially aligned manner.

On end faces remote from one another the particular intermediate ring has complimentary or identical connecting flanges, so that the intermediate rings can in random order be engaged with one another or can be brought onto the opening rim of the suction chamber remote from the container bottom. The at least one intermediate ring and the suction chamber can be secured with respect to one another by axial clamping with the aid of suitable, manually releasable clamping members and can be interconnected in substantially tight manner. If the two connecting flanges have an identical construction, then the particular intermediate ring can be used in two positions at 180° from one another, e.g. with a top or bottom diaphragm switch.

The same intermediate ring can also be used on different or differently designed wet suction apparatuses which can be used for different purposes, provided that there is a corresponding construction of the component flanges to be engaged with the connecting flanges of the intermediate ring. For example a connecting flange can be constructed for direct connection to a dry filter housing of a wet suction apparatus, which is mainly used for sucking up moist or wet solids. Instead of this and in particular in addition thereto, a connecting flange, namely preferably the same connecting flange can be constructed for direct connection to a motor suction fan unit of a water suction apparatus, which e.g. belongs to a swimming pool cleaning apparatus for the filtering cleaning and filtered return of the swimming pool water.

In the case of a suction device of the aforementioned type it is also possible, in addition to or instead of the aforementioned arrangement of a switch to provide in the suction chamber above the separating chamber and between the latter and a suction connection a dry filter in a filter chamber. This solves the problem that in the case of a simple, compact construction and relatively high storage capacity, it is possible to ensure very clean waste air substantially independently of whether moist, wet or dry dirt has just been taken up. The inventive suction device can be used as a dry suction apparatus exclusively for taking up dry dirt.

According to the invention the dry filter is located in the same overall area forming the separating chamber, so that very large filter surfaces can be used for the dry cleaning of the air immediately after the preseparation of optionally present moist particles or liquids. As a result of the inventive construction the suction device only requires a relatively small base surface and there is no need for a moist or wet filter. This obviates the capacity reduction normally linked with such a filter and the moist or wet components are separated in filter-free manner directly in a collecting zone. The inventive suction apparatus is in particular suitable for the disposal of metal and plastic chips on processing machines, in which cooling, lubricating or cutting fluids are frequently used, e.g. in the case of drilling or other machining processes and in spite of the heavy parts and liquids which occur, it is mainly fine dust which is produced. Thus, the wet suction apparatus is particularly suitable for those mixed materials which contain at least three individual materials with different suspension behaviour or different aggregate states.

A particularly simple and compact construction can be obtained if the fill level limiting device is provided for limiting the fill level of the collecting or preseparation chamber. For example on reaching the fill level it closes an intake valve leading to the preseparator or switches off a suction fan or exhauster unit belonging to the suction apparatus until a corresponding emptying has taken place. Thus, there is no need for a partition between the filter chamber and the preseparating chamber. With its full width the preseparating chamber passes directly into the filter chamber. Only relatively low flow rates occur within said overall area even in the case of high suction capacities. Moreover, the emptying of the preseparating chamber and the cleaning or replacing of the dry filter are made particularly simple.

The extension of the dry filter is appropriately such that it roughly corresponds to the inside diameter of the preseparating chamber, so that there is a very good space utilization in the interest of large filter surfaces. The dry filter can be formed in simple manner as a cartridge filter through an approximately cylindrical or circumferential filter body, whose filter shell ensures a much larger filter surface compared with the circumferential surface due to a backwards and forwards, e.g. undulating configuration of the filter material.

Appropriately the chambers or zones of the suction apparatus are formed by engaged, separate casing parts with substantially the same basic cross-section, so that for forming the preseparating chamber it is possible to use a bucket or barrel-shaped tank, on which can be inverted a corresponding smaller tank. One tank forms the base wall and the other tank the top wall of the overall area and it is possible to arrange at least one intermediate ring between the two tanks. The separating chamber or the associated tank can e.g. have a capacity of approximately 50 to 200 liters and preferably approximately 100 liters, whereas the filter housing and the dry filter are appropriately constructed in such a way that they have an effective filter surface of at least 1.5 to 5 $m^2$, preferably approximately 3 $m^2$.

In particular for large quantities of liquid, it is appropriate if the preseparating chamber in the base area has an easily openable discharge opening, e.g. in the form of a check valve or an opening closable by a cover. However, on reaching the maximum fill level it is not always necessary to empty the complete preseparating chamber and instead inititally only the liquid has to be drained off until the solid or heavy parts reach the maximum fill level. The components forming the preseparating chamber and the filter chamber are appropriately not directly integrated with an exhauster and are instead externally fitted to such an exhauster unit, so that said casing parts, independently of the exhauster unit can be moved, i.e. opened or tilted for emptying or for changing filters.

The fill level limiting device could also be completely located outside the preseparating chamber and could e.g. respond to its weight or the like. However, a particularly reliable design is obtained if the limiting device has the limit switch located within the preseparating chamber and responding directly to the sucked in materials. If the limiting device is adjustable with regards to the fill level, this can be achieved by modifying its response sensitivity directly through the vertical adjustment of the limit switch. The limit switch is appropriately connected by means of a concealed and therefore protected connecting line to the control device for the exhauster unit in such a way that through said connecting line the mobility of the preseparator with respect to the exhauster is in no way impaired.

As a result of the inventive construction it is also possible to use a cleaning apparatus, as described in DE-OS 34 10 817, in advantageous manner as a universally usable suction apparatus, particularly for cleaning purposes as are used in fire brigades. For further features and actions of the inventive object reference should be made to the above publication. In place of the float valve or float and the associated float support cage, according to the invention in the case of such a cleaning apparatus a switch directly operated by the suction material is positioned just below the suction port of the exhauster or the ventilator in such a way that the back of the switch casing remote from the diaphragm has a distance from the suction port parallel thereto which is approximately its diameter or less than the latter. As soon as the switch, e.g. due to flooding is operated by the suction material liquid, it switches off the ventilator bringing about the suction flow of the cleaning apparatus until the return device provided as the emptying device has emptied the liquid reservoir constituting the separator through pumps to such an extent that the switch is again freed and as a result the ventilator can be switched on again for the further operation of the cleaning device.

The invention also proposes a wet suction apparatus with a suction chamber and a suction inlet, as well as a suction outlet with which is detachably or completely removably associated a separate pump unit enabling the pumping away of any liquid which has collected in the separating chamber and which can e.g. be brought by means of a feed pipe to a storage tank. This pump unit, which can e.g. have a feed pump integrated into a housing can, if desired, be placed on the floor alongside the wet suction apparatus, can be connected to the latter and then put into operation for the emptying thereof.

These and other features of preferred further developments of the invention can be gathered from the claims, description and drawings and the individual features can be realized individually or in the form of subcombinations in an embodiment of the invention and in other fields and constitute advantageous, independently protectable constructions for which protection is here claimed. An embodiment of the invention is described in greater detail hereinafter relative to the drawings.

DETAILED DESCRIPTION OF THE PREFERRED EMBODIMENT

Figure 1:
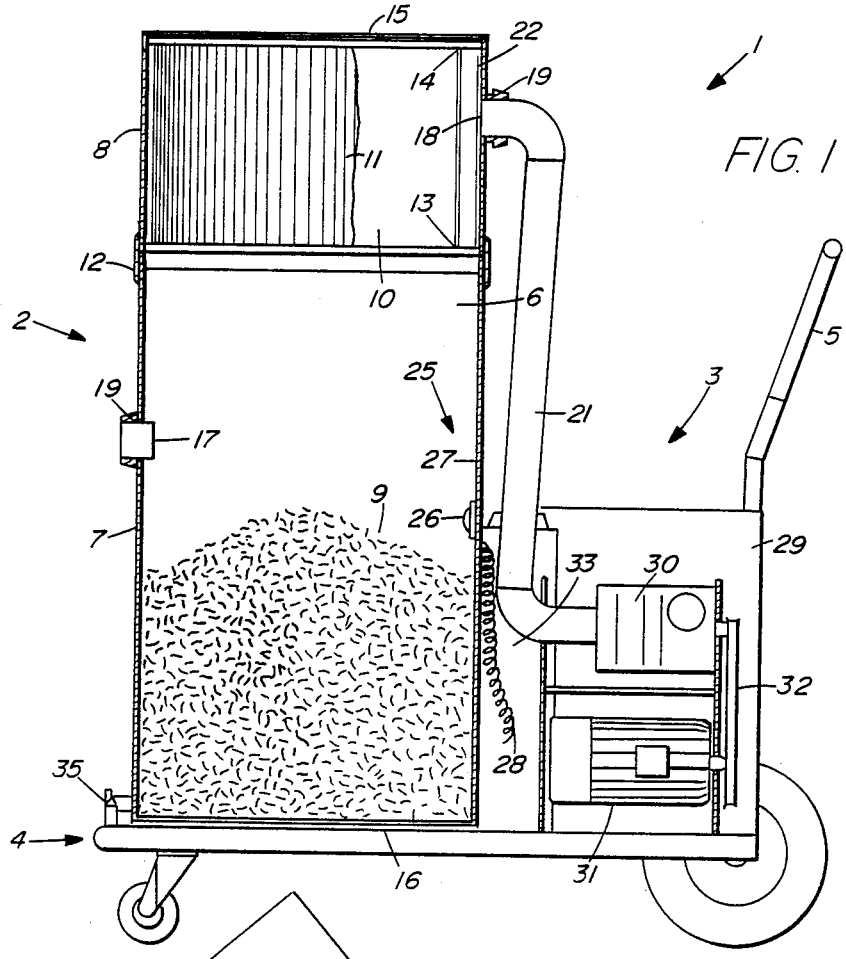
FIG. 1 an inventive wet suction apparatus in vertical section and in simplified form.
Figure 2:
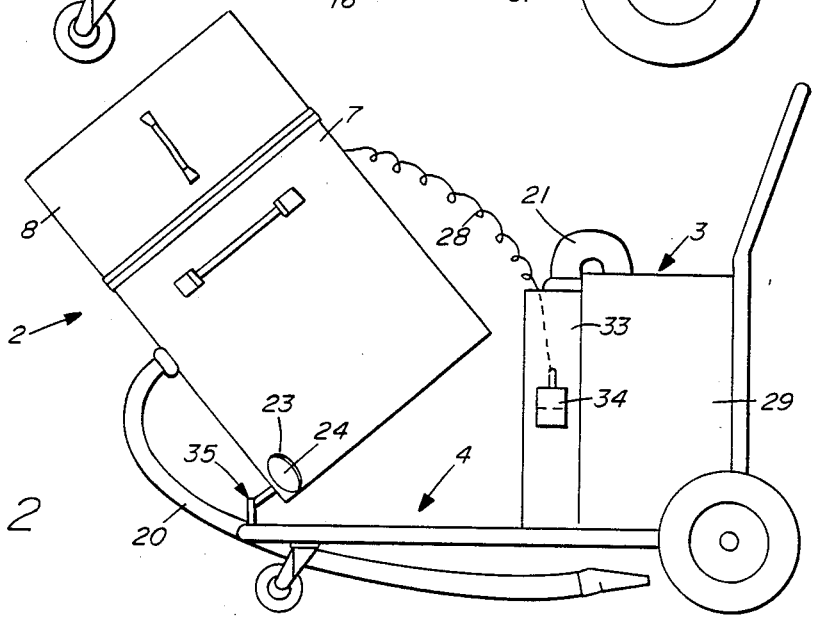
FIG. 2: the wet suction apparatus according to FIG. 1 with the preseparator in the tilted position.

In the embodiment of a wet suction apparatus 1 shown in FIGS. 1 and 2 there is a barrel-shaped, standing main container 2 having substantially the same external and internal cross-sections over its entire height. Behind it and immediately adjacent thereto is a much lower, substantially rectangularly defined suction blower or exhauster unit 3, whose width is roughly the same as the diameter of the main container 2. The main container 2 and the exhauster unit 3 connected substantially uninterruptedly thereto in the working position are arranged on a base part 4 constructed as a chassis. The self-guiding runners located in the vicinity of its front are located below the main container 2 and also it has at its rear end two larger wheels located on either side of the exhauster unit 3. Above said larger wheels is provided a bow-shaped control handle 5 for pushing or pulling the mobile suction apparatus. The exhauster unit 3 is arranged essentially between said handle 5 and the main container 2 at the rear end of the base part 4.

Together with a planar, uninterrupted base wall and a corresponding, substantially vertically superimposed parallel cover or top wall within the container casing, the main container 2 forms a suction chamber 6 having essentially the same cross-sections over its entire height. The suction chamber is formed by two separate invertedly superimposed individual containers, namely a lower container in the form of a simple sheet metal tank 7 and an upper container in the form of a filter housing 8. Tank 7 and the filter housing 8 which is also constructed in the form of a simple sheet metal tank can have a substantially identical construction. For example they essentially comprise a container casing closed by a double flanged seam and a top or bottom wall fixed by flanging.

With a lower part of its height connected to base wall 16, tank 7 forms a preseparating chamber 9. Over substantially its entire height, the filter housing 8 forms a filter chamber 10, in which is arranged a dry filter 11. Dry filter 11 constructed as a filter sleeve has an external diameter, which is only slightly smaller than the internal diameter of filter housing 8. The internal diameter of dry filter 11 is considerably smaller than its material thickness compared with the external diameter because the flat filter material is folded backwards and forwards in zig-zag manner between the outer and inner circumference. On the lower, open end face, the filter housing 8 has a downwardly projecting collar 12, which passes round the outer circumference of tank 7 in slightly raisable manner and reciprocally precisely centers the two housing parts. In order that even not minor air quantities can be sucked out of the suction chamber 6 and passed the drive filter 11, ring disk-like, relatively soft seals 13,14, e.g. of foam rubber are provided on both ends of the dry filter 11 and the latter is secured between them. The lower seal 13, which is roughly level with the lower end face of filter housing 8, can also be used for the outwardly sealed connection of the filter housing 8 to tank 7. The upper seal 14 engages directly on the top wall 15.

A suction inlet 17 and a suction outlet 18 in each case directly issue into the suction chamber 6 and are formed by a sleeve 19 passing through the associated casing for the readily detachable connection of an e.g. hose-like suction duct. In the case of the suction inlet 17 a flexible suction hose 20 with a mouthpiece at the end is connected for taking up the material to be sucked up. A flexible suction duct 21 of the suction blower unit 3 is connected over part of its length to the suction outlet 18.

The suction outlet 18 issues directly into a filter chamber 22 circularly surrounding on the outer circumference the dry filter 11 and which is outwardly defined by the casing of filter housing 8 and through which the suction air substantially over its entire circumference uniformly acts on the filter 11, although the suction outlet 18 located above the centre of the height of dry filter 11 is only provided on a limited circumferential zone of the filter housing 8 facing the exhauster unit 3.

Suction inlet 17, like the suction outlet 18, is radial with respect to the central axis of tank 7, but is formed by a connection projecting slightly inwardly and freely into the suction chamber 6 and is positioned above the centre of the height of tank 7 or above the maximum filling height of the preseparating chamber 9. Materials entering through the suction inlet 17 are so separated from the jointly entering suction air flow by gravity and optionally by rebounding against the facing side of the tank casing that they cannot come into the vicinity of the dry filter 11. The remaining suction air flow, which may contain fine dust, passes into the inner area of dry filter 11, bounded by the latter and which is only slightly less wide than the inside diameter of tank 7, then through the same into filter chamber 22 and finally through the suction outlet 18 out of the suction chamber 6.

The dust collecting on the inner circumference of dry filter 11 can be considerably detached by knocking on the filter housing 8 and same then falls into the preseparating chamber 9. However, if the chips are not subject to the dust, then the latter can be knocked off after removing the filter housing 8 from the dry filter 11, so that the latter has a relatively long service life.

So as to only have to empty solids from the preseparating chamber 9 when they have reached the maximum fill level and not when the liquid or water level has correspondingly risen, a liquid emptying device is provided, which is e.g. formed by an emptying opening 23 in the base region, which can be closed by a cover 24 easily removable from the outside, so that the liquid can be drained off at any time.

For automatically limiting the fill level of the preseparator formed by tank 7 a limiting device 25 for said level is provided. It has a limit switch, e.g. in the form of a diaphragm switch 26 located within the preseparating chamber 9 directly on the inner circumference of tank 7. The diaphragm switch is vertically adjustable by an adjusting device 27 and can be fixed in the set position. The limit switch 26 faces the suction inlet 17 substantially opposite to the side of tank 7 facing the suction blower unit 3 and acts on the latter by means of a helical connecting line 28 passing through the tank casing.

The sound insulated exhauster unit which has a sound insulated casing 29 is provided within the latter with a horizontal exhauster 30 and an exhauster motor 31 directly adjacent thereto. The exhauster and motor are vertically superimposed in such a way that the motor 31 is located directly above the base part 4 and the exhauster 30 is above the exhauster motor 31. Between said two units is provided a substantially horizontal partition. The exhauster motor 31 is drive-connected to exhauster 30 by a single-stage transmission gear 32, which is located on the side of exhauster 30 and motor 31 remote from the main container 2 in the casing 29.

The exhauster 30 sucks in axially on its side facing the main container 2 and to said side is connected the suction duct 21 by means of a pipe bend. Immediately adjacent to the main container 2, said suction duct 21 is led upwards through a sleeve out of the top of a connecting casing 33, which is positioned between casing 29 and main container 2 and is so adapted to its circumference that it surrounds same on a partial circumference. The connecting line 28 is located in concealed manner in the connecting casing 33 and is connected to a motor protection switch 34, which is laterally fixed to the outside of the connecting casing 33. The upper end of suction duct 21 also has a bend for the easily detachable connection to the associated sleeve 19. Between the two pipe bends, the suction duct 21 is formed by a substantially linear, vertical, flexible hose.

The main container 2 or tank 7 can be arranged in easily removable manner on base part 4, so that it can be tilted over separately from the latter for emptying purposes. For this purpose and for carrying purposes on the outside of tank 7 or filter housing 8 are in each case provided suitable handles. Main container 2 or tank 7 can also be tiltably mounted directly on the base part 4 and for this purpose a joint 35 is appropriately provided between tank 7 and base part 4, whereof the horizontal joint axis is located approximately level with the base or underside of tank 7 on the side thereof remote from the exhauster unit 3 and slightly outside the outer circumference of tank 7. Thus, during pivoting in accordance with FIG. 2, the tank 7 is readily detached from the connecting casing 33. Main container 2 or tank 7 can also be pivotably and removably mounted. For this purpose the joint bolt of joint 35 is appropriately arranged so that it can be raised out of the ball and socket joint.

Base part 4 appropriately comprises a horizontal tubular frame, which projects laterally over the outer circumference of main container 2 to such an extent that it forms an impact protection. Joint 35 is located on the front end of said horizontal tubular frame and slightly above its top surface. Thus, after removing the filter casing 8, the tank 7 can be forwardly pivoted from its upright position into a tilting position, where its open top side is slopingly downwardly directed, so that under gravity its content can automatically slide out without any particular effort.

Figure 3:
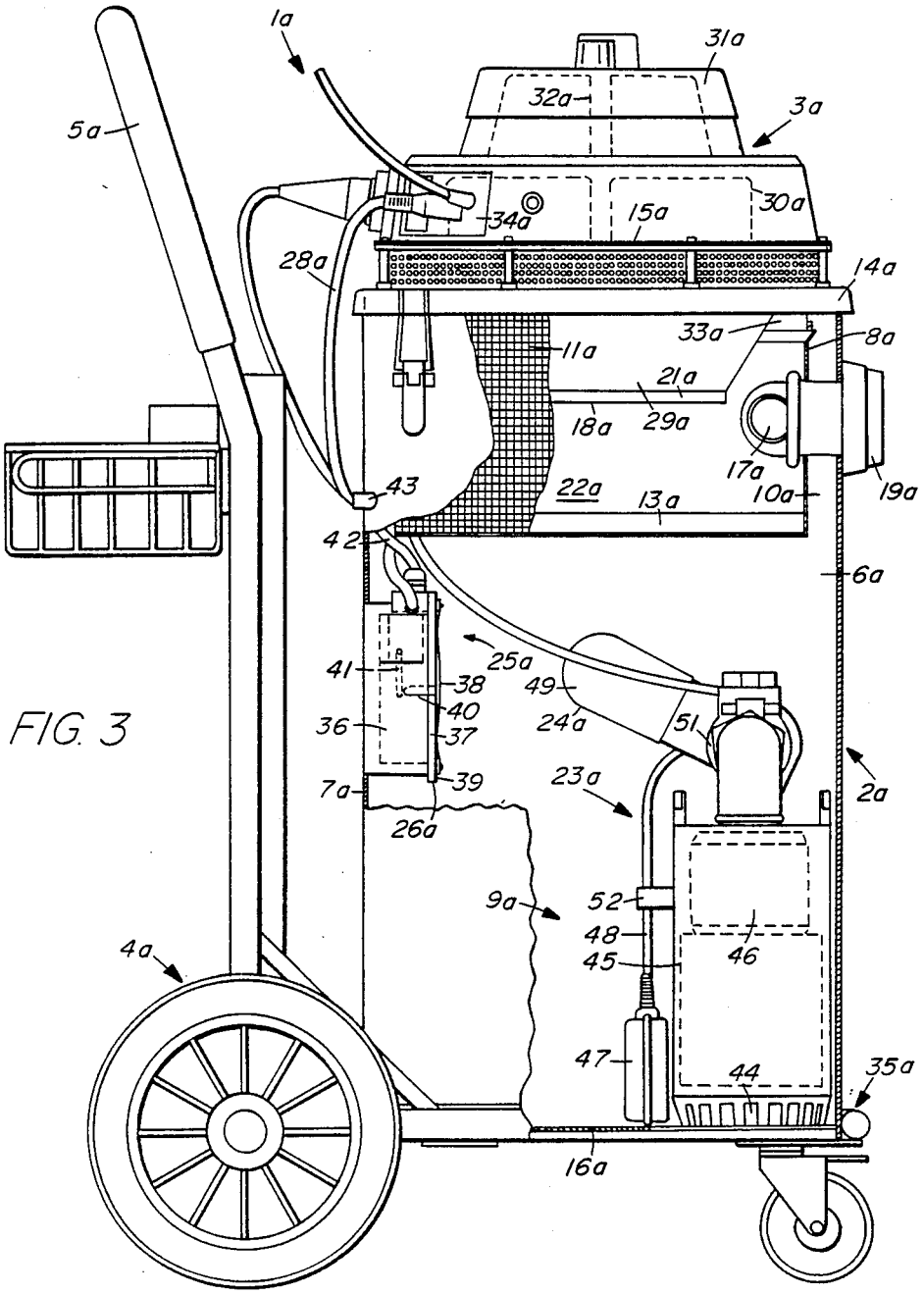
FIG. 3: another embodiment of a wet suction apparatus, partly in vertical section.
Figure 4:
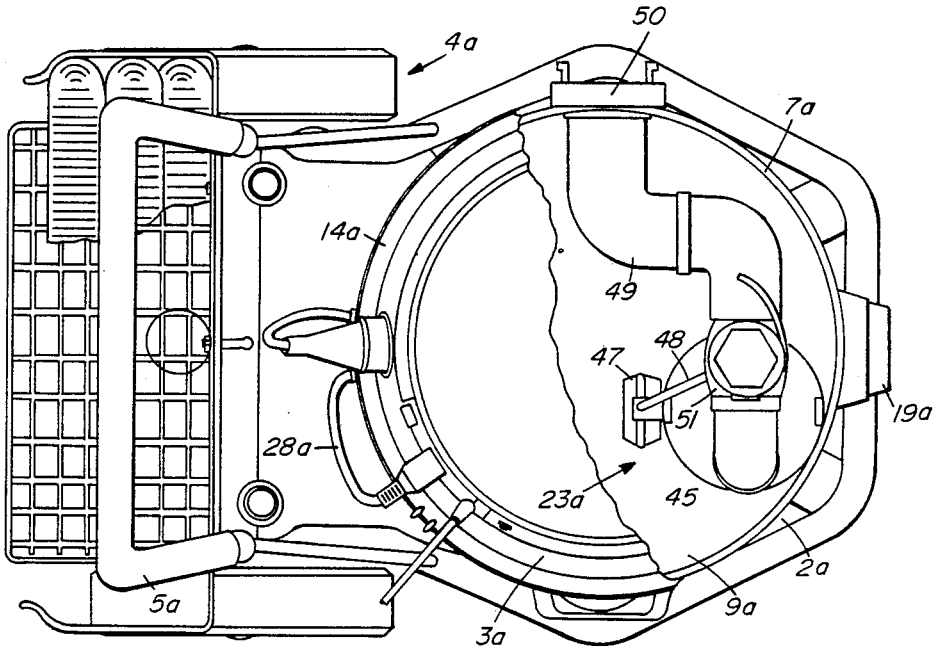
FIG. 4: the wet suction apparatus according to FIG. 3 in part sectional plan view.
Figure 5:
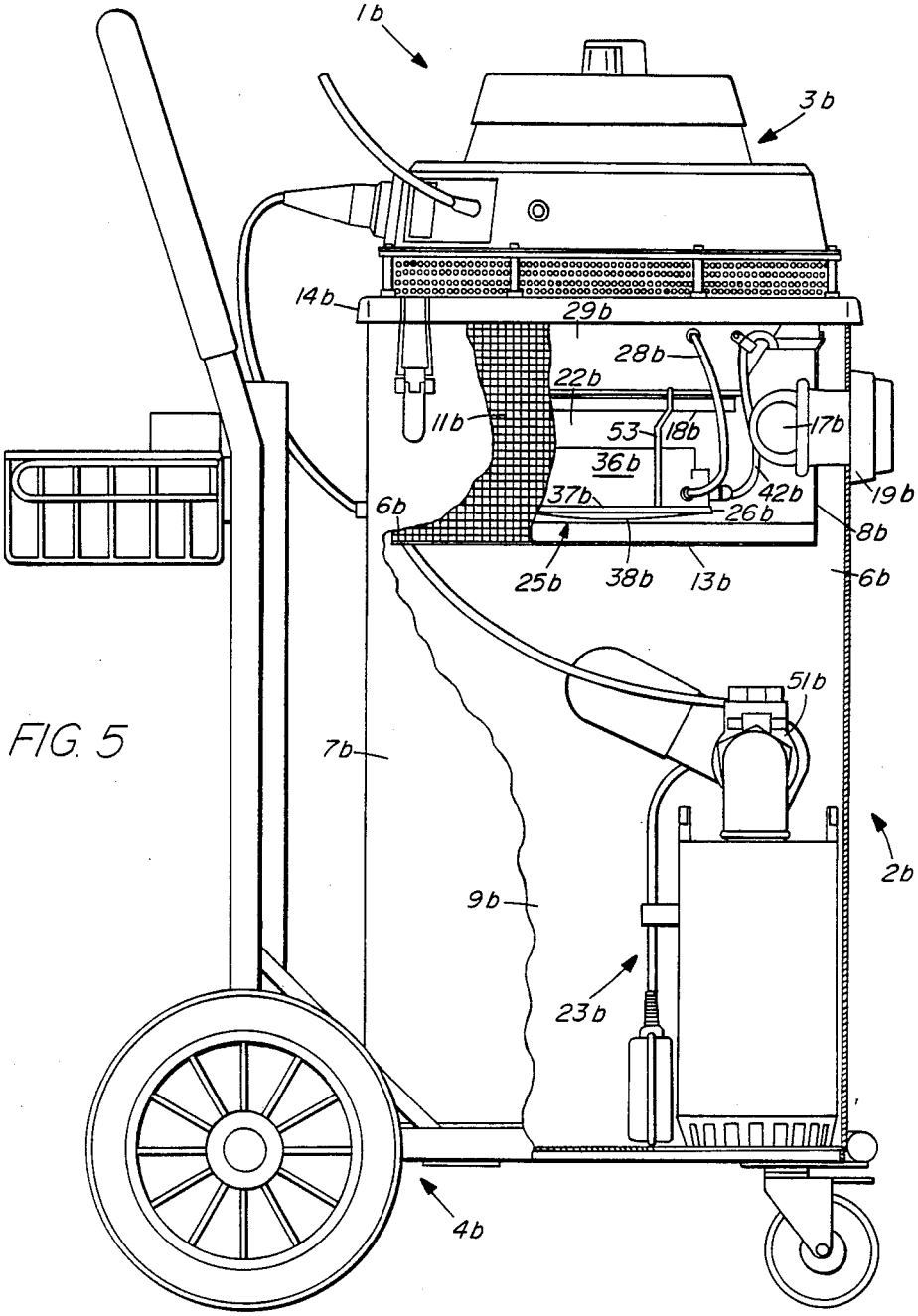
FIG. 5: another embodiment in a representation according to FIG. 3.

In FIGS. 3 to 5 corresponding parts are given the same reference numerals as in FIGS. 1 and 2, but followed in FIGS. 3 and 4 by a and in FIG. 5 by b, the description being essentially the same.

In the embodiment according to FIGS. 3 and 4 the suction blower or exhauster unit **3*a* is located directly on the top of the main container 2*a*, so that it projects at least somewhat downwards into the sheet metal tank 7*a* and forms the main container cover 14*a*** easily detachable by quickacting locking means.

Exhauster unit 3a has a substantially centrosymmetrical casing 29a, which projects with an acute-angled, frustum-shaped, downwardly tapering casing surface into tank 7a over a small part of its overall height. With its lower end formed by a collar 21a, namely with its suction port 18a, the casing forms the suction outlet of suction chamber 6a. In axially successive manner and combined to form a subassembly within the casing 29a are arranged the exhauster 30a extending roughly up to the suction port 18a and above the same the exhauster motor 31a. The fan wheel of exhauster 30a is arranged directly on the motor shaft 32a. Directly above the upper end of the main container 2a forming the tank opening the exhauster unit 3a has a spent air outflow casing 15a, which forms a longitudinal portion of casing 29a. The complete exhauster unit 3a can be raised or detached with respect to tank 7a.

To the upper end of tank 7a is detachably or removably fixed the filter housing 8a which coaxially freely projects downwards therein. The surface of said filter housing 8a, which extends downwards and upwards over and beyond the suction port 18a is formed by a relatively coarse wet filter 12a, e.g. a fine-mesh wire grid, which is engaged from above on a connecting casing 33a and is e.g. secured by screws. The outer casing 33a can be fixed in particular detachably to the tank 7a or also outside the outer circumference of the conical casing connection to the exhauster unit 3a. The substantially planar, disk-shaped base 13a of filter housing 8a is completely closed, so that liquid reaching it below the suction port 18a can only pass radially inwards to outwards through the wet filter 11a into the preseparating chamber 9a.

The suction inlet 17a for connecting the flexible suction hose to a sleeve 19a is located within the filter housing 8a. A connecting sleeve between sleeve 19a and a suction head forming the suction inlet 17a passes through the tank 7a and the filter housing surface or wet filter 11a in radial manner. The suction inlet 17a is immediately adjacent to the inside of the filter housing surface. Its central axis determining the intake direction of the suction material is aligned approximately tangentially to the central axis of the suction port 18a or the main container 2a coaxial thereto and in an approximately horizontal manner in such a way that the suction inlet 17a is located at a limited distance and radially outside the suction port 18a. The central axis of the suction inlet 17a is roughly level or only slightly below the suction port 18a. Thus, in this case the filter chamber 22a is within the wet filter 14a, whilst the filter chamber 10a subject to the action of the filtered suction material circumferentially surrounds the filter housing 8a.

The diaphragm switch 26a is in the present case secured in fixed manner to the wall of tank 7a and can be arranged completely on the inside of said wall or can pass through the same in the manner of a cover, so that a collar-like casing flange 37 projecting over the outer circumference engages on the inside of said wall.

Figure 6:
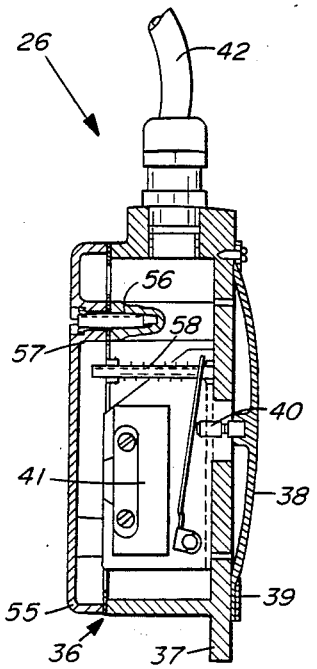
FIG. 6: an inventive diaphragm switch in axial section.
Figure 7:
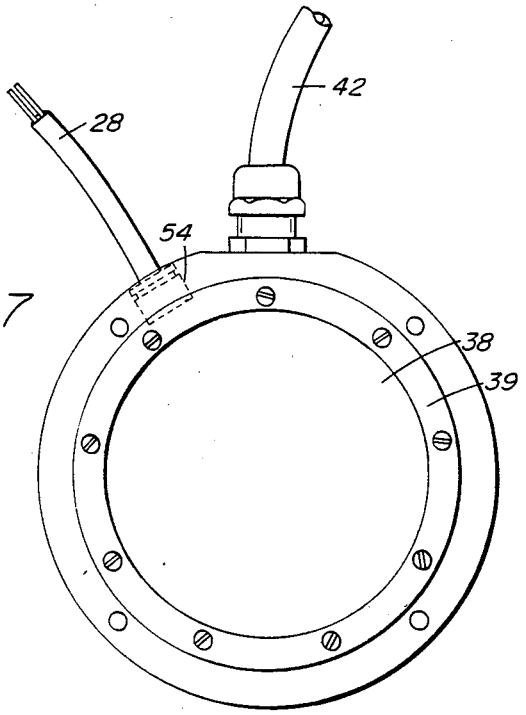
FIG. 7: the diaphragm switch in front view.

As can in particular be gathered from FIGS. 6 and 7, the diaphragm switch 26 has substantially cylindrical switch casing 36, which is much less long than its external diameter and at whose front end the casing flange 37 projects in annular manner. The front end of the cup-shaped switch casing 36 is closed by an elastic diaphragm 38 extending approximately over its entire diameter. The circumferential edge thereof is braced with a circular disk-like locking member 39 against the front face of the switch casing 36. On the inside of the diaphragm 38, which is otherwise within its border curved convexly outwardly in contact-free manner is fixed by a plug connection a rod 40 axially movable with the diaphragm and provided in its axis. The end of the rod remote from the diaphragm 38 acts on the contact of a microswitch 41 housed in liquid-tight manner within casing 36.

Switch casing 36 is closed at its rear by a sealed cover 55, whose fastening scres 56 are sealed with ring seals 57. Rod 40 works against a compression spring 58 acting on a control lever and which is positioned on an adjusting screw and is adjustable with a nut after opening casing 36. Said adjusting screw can also be passed in sealed manner out of the switch casing 36 or the tank and is consequently always accessible.

The electric lead 28 for the microswitch 41 is sealed roughly radially on the top surface and is led out of the switch casing 36 through a screw coupling 54. Above the switch casing 36 and above the base 13a adjacent to the wet filter 11a it is led according to FIG. 3 through a mouthpiece 43 out of the tank 7a. It runs from mouthpiece 43 outside tank 7a upwards to a connecting base 34a, which is located above the exhauster blow-out openings on casing 29a. Lead 28a is connected by a detachable plug coupling to the connecting base 34a.

The tightly surrounded area of switch casing 36 is connected by means of a line, particularly a flexible hose line 42 above suction opening 18a or in the top area, to the suction chamber 6a. The upper, not shown end of the hose line 42 can be downwardly directed on the outside of wet filter 11a. This leads to a pressure compensation, through which the same vacuum prevails behind diaphragm 38 as in the suction chamber 6a. The connection of the hose line 42 and the cable duct can be closely adjacent to one another on the switch casing 36.

Into the preseparating chamber 9a provided as a reservoir issues in the lower most region, i.e. in the immediate vicinity of base 16a, at least one suction port or all the suction ports 44 of a return means 23a for the entire liquid. Said return means 23a has a pump 45 constructionally combined with an electric motor 46 and constructed in the manner of a submersible pump and to whose top surface is fixed the motor 46 in an equiaxial arrangement. In the lower area the pump has on its circumference the suction ports 44. Pump 45 is fixed in tank 7a standing on base 16a. Power is supplied to the electric motor 46 by means of a mains cable led away at right angles through tank 7a from the top of the return means 23a and below base 13a. The mains cable is led out of tank 7a roughly level with mouthpiece 43 and is connected by a detachable plug coupling to the connecting base 34a.

In the electric lead to electric motor 46 is arranged a float switch 47, which is connected by means of a flexible insulated cable led out in sealed manner from the top of the return means 23a and which is positioned below a cable mounting support 52 receiving the cable. The mounting support is mounted in rotary manner on the outside of return means 23a about a roughly horizontal axis at right angles to the cable. In the initial state float switch 47 is located on base 16a alongside the return means 23a facing the diaphragm switch 26a. On reaching a predetermined liquid level in the preseparation chamber 9a, the float switch 47 floats up into a predetermined position. It thereby rotates about the rotation axis of the cable mounting support 52 guided in a precisely defined manner. Thus, float switch 47 is closed, so that electric motor 46 is switched on until through pumping out the liquid in preseparation chamber 9a the liquid level has dropped to a predetermined lower level, so as to switch on pump 45 again.

The outlet opening of pump 45 located at the top or above electric motor 46 is connected to the lower end of a pressure line 46 led up in the preseparation chamber 9a. The pressure line 46 essentially comprises three interconnected, angular pipe bends and below the base 13a of filter housing 8a is led outwards through the casing of tank 7a. Pressure line 49 is provided with a hose connecting coupling 50 fixed to the casing of tank 7a of the type used for fire brigade hose connection. This connecting coupling 50, related to the direction of travel of chassis 4a, is located laterally on tank 7a. In the pressure line 49 and namely between the two pipe bends closer to the pump 45 is arranged a non-return valve 51, which closes in the case of a vacuum on the side towards pump 45, so that in this case no liquid or air can flow back through the pump 45 into the preseparation chamber 9a. If the return means 23a is not able to pump out as much liquid as flows in through the suction inlet 17a and the liquid level rises above a predetermined level positioned below base wall 13a, e.g. in such a way that the diaphragm switch 26a is almost completely immersed in the liquid, then the exhauster motor 31a is switched off by means of microswitch 41, whilst the return means 23a continues to pump. If the liquid level then drops below the limit, then the microswitch 41 and consequently motor 31a are automatically switched on again by means of the diaphragm 38. Thus, after switching on the wet suction apparatus 1a and at a considerable distance therefrom it is possible to continuously work on the connected suction hose without an additional operator being required for the switching operations, because an automatically regulated disposal means is provided for the suction chamber. The main container 2a can be merely connected via a plug connection 35a to chassis 4a, so that it can be raised from the latter.

Whereas the embodiment according to FIGS. 3 and 4 is particularly suitable for use as a fire brigade suction apparatus, that according to FIG. 5 is particularly intended as a cleaning apparatus for swimming pools or the like and as is described in DE-OS 34 10 817 (see opening application ser. no. 048 985, filing date 05/11/87). The wire grid or the like located in the vicinity of the filter housing 8b appropriately serves in this case on the inside for supporting a waterproof, fine wet filter. The latter can be in the form of a flexible filter bag made from a paper fleece or the like or such a bag which is approximately cylindrical in the widened state. Its width is only relatively slightly larger than the inside diameter of the filter housing 8b. The wet filter in the form of a disposable filter is replaceable and is traversed by the inlet connection.

In this embodiment the diaphragm switch 26b of the fill level limiting device 25b is arranged axially parallel or coaxial to tank 7b and to the suction port 18b within the filter housing 8b so as to be substantially freely suspended. The diaphragm 38b located on the underside of the switch casing 36b is located slightly above the base 13b filter housing 8b. The top of the switch casing 36b formed by the back surface is spaced below the suction port 18b. The external diameter of the switch casing 36b can be at least as large or slightly smaller than the width of the suction port 18b. The diaphragm switch 26b can be fixed directly to the casing 29b or to its casing part located in the tank 7b, e.g. with a mounting support 53. Mounting support 53 has a ring surrounding said casing part and from same downwardly projecting supporting members. On the lower ends of the supporting members is fixed the casing flange of switch casing 36b.

The response sensitivity of diaphragm switch 26b is appropriately such that the switching process is initiated if the water level has risen to the upper region of the switch casing 36b. Thus, diaphragm switch 26b prevents both the rising of the water above a predetermined limit within the filter chamber 22b and also within the preseparation chamber 9b. Although conceivable, for the preseparation chamber there is no need to provide a separate diaphragm switch in accordance with FIGS. 3 and 4.

For using said cleaning apparatus to the sleeve 19b is connected one end of a suction hose and which is provided at the other end with a suitable suction or pool cleaning head. Once again by means of a suitable coupling piece a hose of adequate length which can sink in water is connected to the hose connecting coupling of the pumping out or return means 23b. The cleaning apparatus is set up with the chassis 4b alongside the edge of the swimming pool, the sinkable hose is let down into the water-filled pool and the suction head is also lowered into the same. After switching on the apparatus or the blower or exhauster unit 3b a vacuum is built up in suction chamber 6b, accompanied by the closing of the non-return valve 51b and as a result of this the contaminated water is sucked through the suction inlet 17b into the wet filter and after flowing through the latter from the inside to the outside is collected in the preseparation chamber 9b. As soon as the water level in the preseparation chamber 9b has reached the indicated level, the return means 23b is switched on, so that counter to the vacuum in tank 7b and therefore co-operating in maintaining or increasing this vacuum the collected water is pumped out whilst opening the non-return valve 51b and is returned to the swimming pool. The pressure compensation for the filter housing 36b takes place by means of the hose line 52b, which in the case of a sufficiently large inside diameter could also receive the electric feed cable 28b, so that it would only be necessary to have a single passage in the switch casing 36b and in the housing 29b.

Figure 1A:
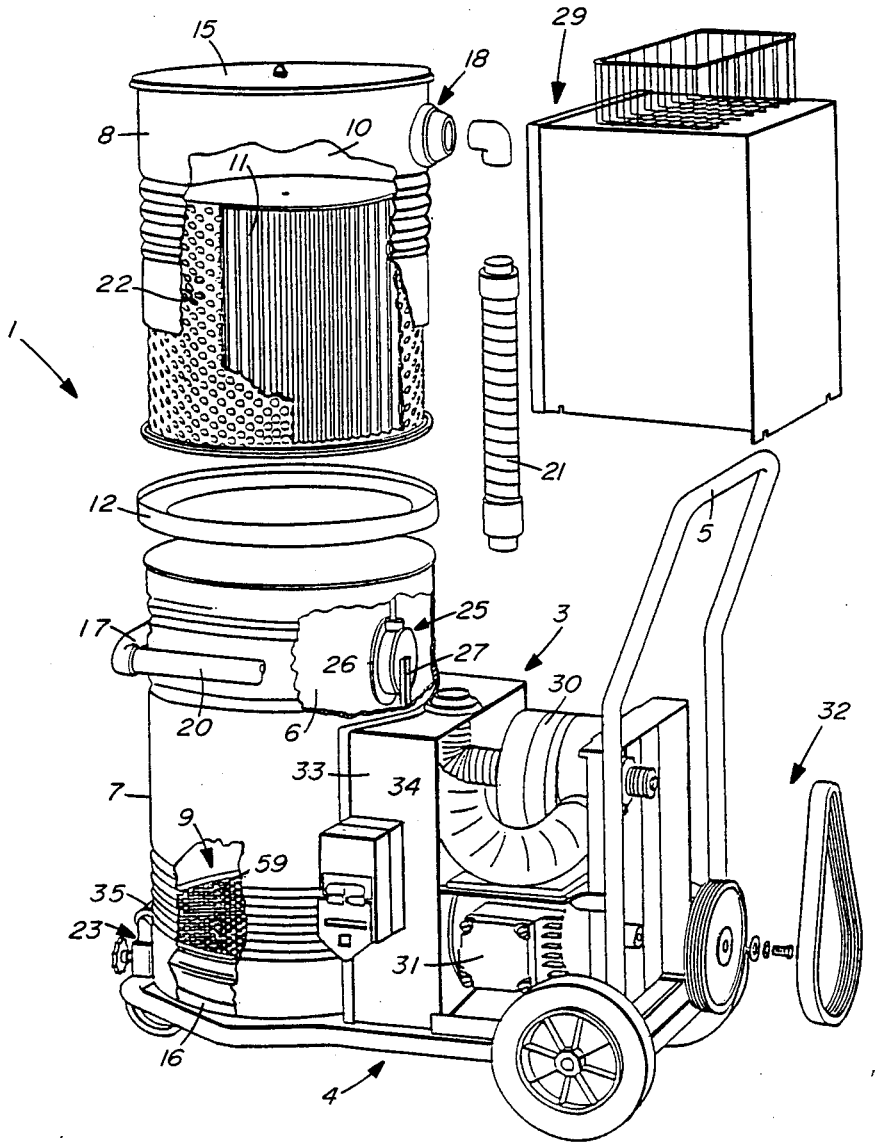
FIG. 1*a*: the wet suction apparatus according to FIGS. 1 and 2 in a perspective, partly exploded representation and with minor modifications.

The wet suction apparatus according to FIG. 8 once again fundamentally corresponds to the construction of FIGS. 1, 1a and 2, but in this case tank 7c has at least one substantially circumferential intermediate ring 60, which forms an intermediate segment free from the end walls between two longitudinally interconnected casing parts having end walls, namely tank 7c and filter housing 8c. Intermediate ring 60 has essentially the same width as at least one of said two casing parts and is provided at both ends with connecting flanges 61, 62. Both connecting flanges 61, 62 are identically constructed and can be formed by simple angle section rings, whose radially inwardly projecting profile leg at right angles to the central axis of intermediate ring 60 forms a contact shoulder and optionally serves to receive a ring seal. Into the lower connecting flange 61 fits in substantially radial clearance-free manner the upper edge of tank 7c. The lower end of filter housing 8c fits into the upper connecting flange 62.

As is shown in FIG. 1a, a short, separate annular flange 12 replacing the connecting collar according to FIGS. 1 and 2 can be provided for connecting the casing part 7, 8, which is e.g. T-shpaed in cross-section and has a radially inwardly directed T-foot and essentially forms no circumferential casing. Interchange between flange ring 12 and intermediate ring 60 is readily possible. The intermediate ring 60 e.g. has an axial extension between one third and one quarter of its width and is sufficiently large that the sleeve forming the suction inlet 17*c* just has sufficient space between the two connecting flanges 61, 62 in the casing of intermediate ring 60. By replacing intermediate ring 60 by one having a differently constructed inlet connecting sleeve the wet suction apparatus can be adapted to the hose fitting which is available or to be used.

Figure 10:
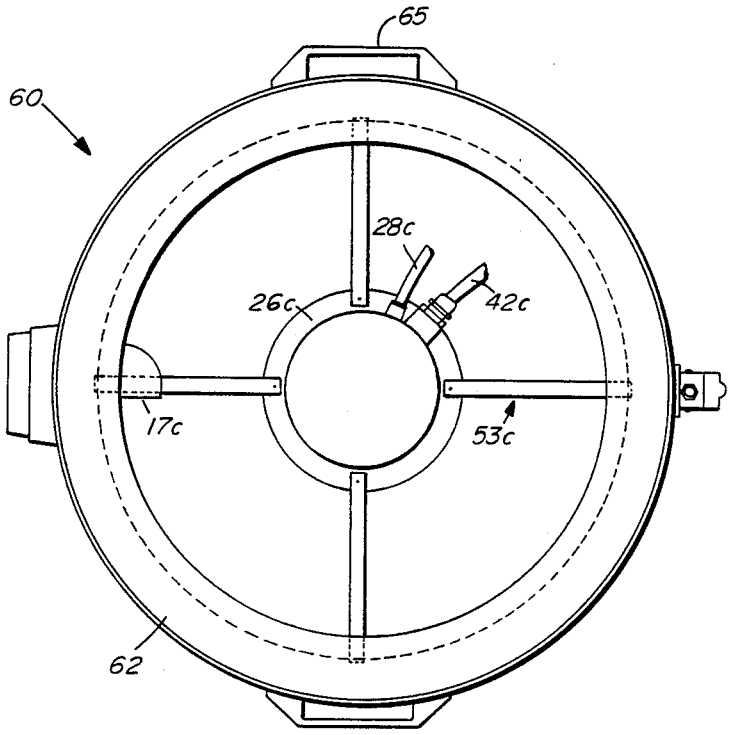
FIG. 10: the intermediate ring according to FIG. 9 in plan view.

Intermediate ring 60 also carries the limit switch 26*c* and in an arrangement similar to that described relative to FIG. 5. Limit switch 26*c*, which is coaxial to the intermediate ring 60 and is much less wide than the inside diameter thereof is fixed to four angular supporting arms of a mounting support 53 uniformly distributed over the circumference. Limit switch 26*c* is located with a spacing below the lower connecting flange 61, said spacing roughly corresponding to the axial extension of the limit switch. The diaphragm of the limit switch 26*c* is directed downwards. In addition, the connecting line 28*c* is passed through the casing 63 of intermediate ring 60 on the side diametrically facing suction inlet 17*c* and is connected to an attaching plug 64, which is fixed to the outside of intermediate ring 60, as well as having a detachable detent for the matching plug to be connected. Thus, not only is the intermediate ring 60 detachable, but this also applies to all the functional units arranged thereon but which require a connection, namely simple plug connections. As shown in FIG. 10, the suction inlet 17*c* issues tangentially or circumferentially into the intermediate ring 60, as described relative to FIG. 3.

The suction inlet 17*c* and the attaching plug 64 are located roughly in a common axial plane of intermediate ring 60 and roughly symmetrically to the axial plane at right angles thereto to bow-shaped handle 65 are fixed to the outer circumference of intermediate ring 60, so that the latter can be simply and securely carried and fitted with both hands. When using the intermediate ring 60 in place of the flange ring 12 according to FIG. 1*a*, it is necessary to use a correspondingly longer suction duct 21*c*, which is appropriately easily detachably fixed or connected to the exhauster unit 3 or the connecting casing 33 by means of a socket engaging in a sleeve.

Figure 11:
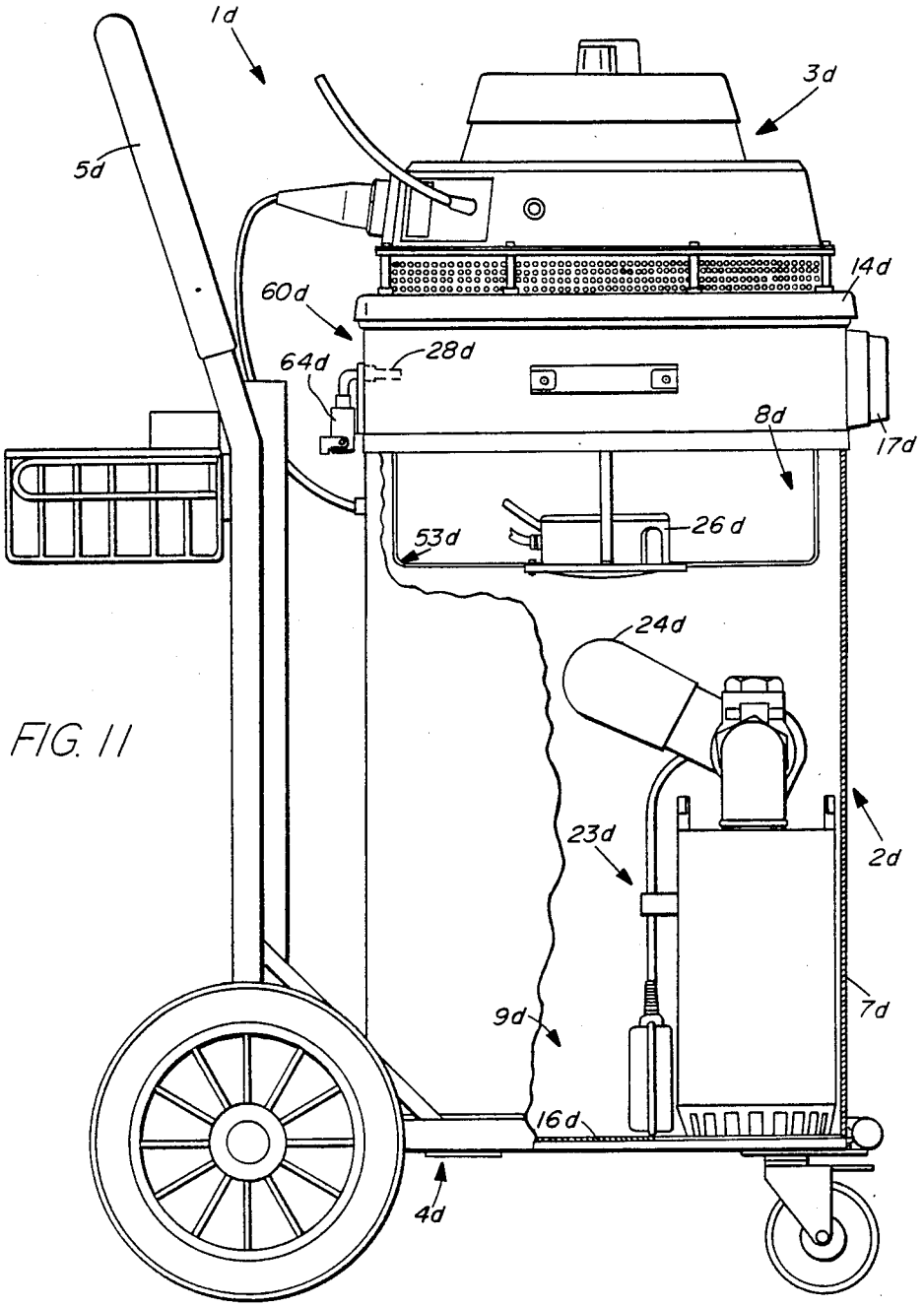
FIG. 11: a wet suction apparatus similar to FIG. 5, but in a modified construction.

Otherwise in FIGS. 8 to 11 the same parts carry the same reference numerals as in the other drawings, but in FIGS. 8 to 10*c* is added and in FIG. 11*d* is added.

Figure 8:
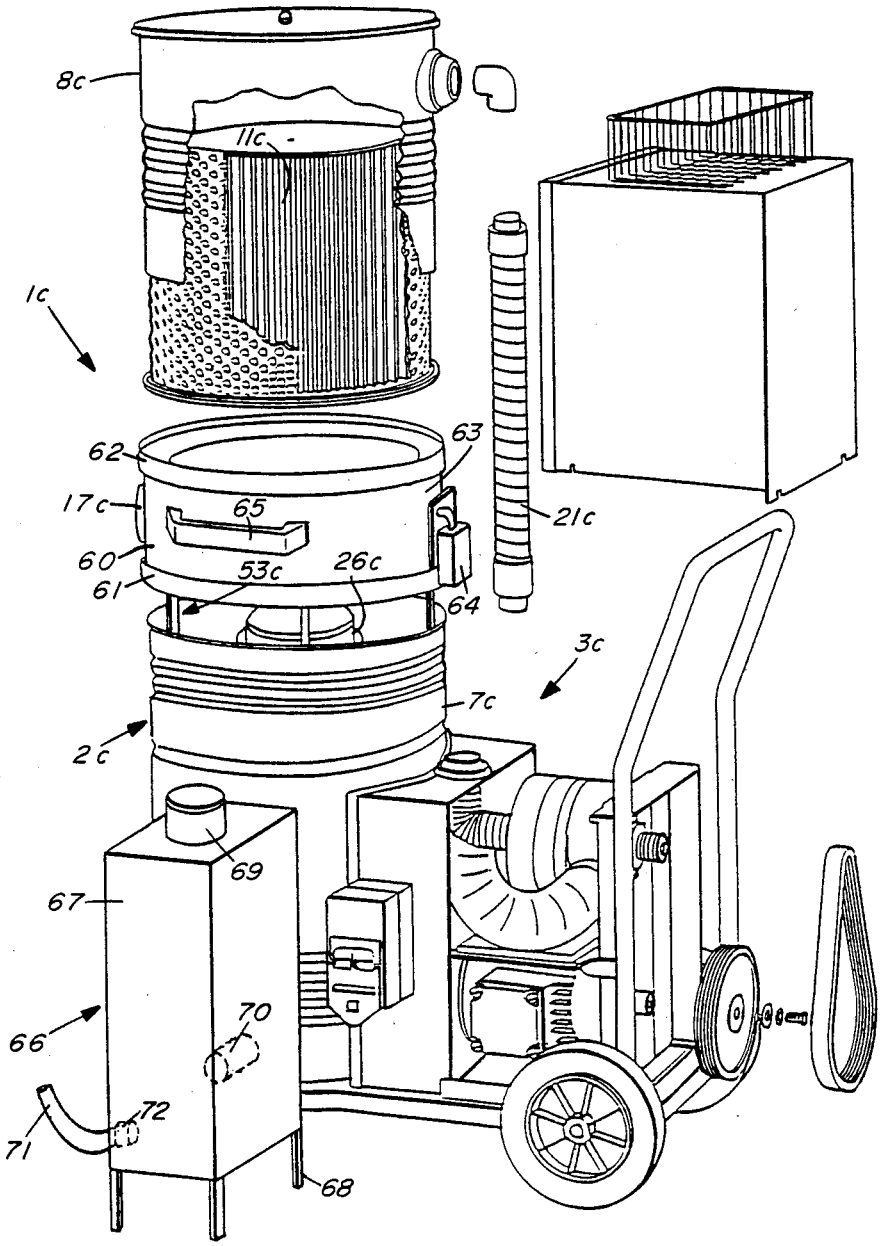
FIG. 8: another embodiment of the wet suction apparatus in a view corresponding to FIG. 1*a*.

As is also shown in FIG. 8 a separate pump unit 66 can be provided for pumping the liquid out of the main container 2*c*. This pump unit 66 has in a console 67 standing on the ground with feet 68 an electromotively driven liquid pump 69. Pump unit 66 is connectable via a connecting coupling 70 to an outlet or to the emptying opening of main container 2. Pump unit 66 also has a connecting coupling 72 for a leading away feed line 71 and which is e.g. formed by a flexible hose. The separate pump unit 66 leads to an operation of the wet suction apparatus similar to that of FIGS. 3 to 5, but in which the pump unit is located within the main container. As can also be gathered from FIG. 1*a*, above the base wall 16 of main container 2 can be provided a screen like grating 59, e.g. comprising wire netting or metal mesh and on which any solid particles can be deposited and allowed to drip away through the grating 59. The pumping away of the liquid for emptying purposes takes place below the grating 59.

Figure 9:
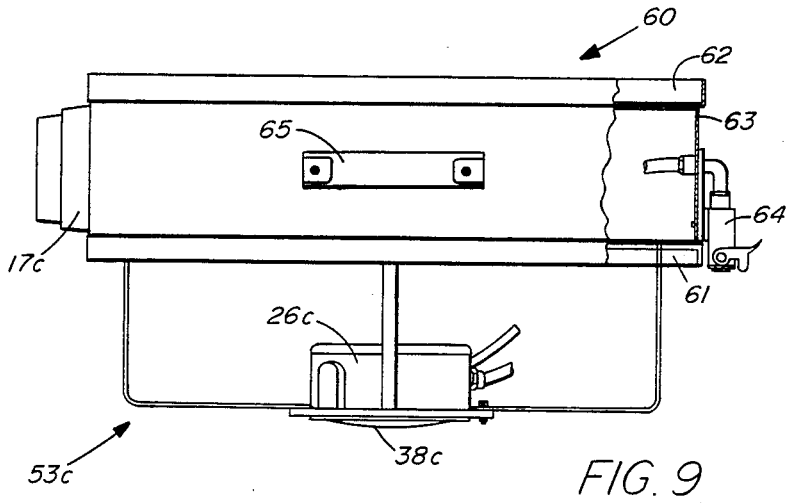
FIG. 9: the intermediate ring of the wet suction apparatus according to FIG. 8 in a part sectional side view.

The embodiment according to FIG. 11 once again relates to a wet suction apparatus, whose fundamental construction corresponds to that of FIGS. 3 to 5. The intermediate ring 60*d*, optionally the same intermediate ring as described relative to FIGS. 8 to 10, is in this case mounted on the upper end of the main container 2*d*. Thus, here again the limit switch 26*d* is spaced below the upper edge of main container 2*d*. The exhauster unit 3*d* is mounted on the upper connecting flange or the upper end of intermediate ring 60*d*. Not shown locking means similar to those of FIGS. 3 and 5 are used for bracing the intermediate ring 60*d* with respect to the main container 2*d* and the exhauster unit 3*d*. Said locking means can engage directly between the main container 2*d* and the exhauster unit 3*d*, so that they secure by axial bracing the said intermediate ring 60*d* between said two components.

The wet suction apparatus according to FIG. 11 can be operated with or without the wet filter described relative to FIGS. 3 to 5. If a wet filter is used the described filter mounting support is appropriately provided on the intermediate ring, so that it can be simply replaced therewith. The filter mounting support can be provided besides the limit switch or in addition thereto. It can also form the mounting support for the limit switch. Due to the fact that the suction inlet is provided on the intermediate ring, the remaining container and in particular the main container can be completely circumferentially closed and have no inlet sleeve. The suction inlet can be positioned below the limit switch instead of above the same.

I claim:

1. A suction apparatus for collecting loose material, comprising:

a suction chamber means into which the loose material is sucked;

a suction inlet means penetrating said suction chamber;

a suction outlet means penetrating said suction chamber; and a diaphragm switch mounted on said suction apparatus with a diaphragm exposed to said suction chamber, wherein said switch is operated by contact between said diaphragm and the loose material and said switch comprises a switch casing and a pressure compensating line leading from inside said switch casing to a portion of said suction chamber above a maximum desired material level.

2. The suction apparatus according to claim 1, further comprising:

a material separating chamber within said suction chamber, wherein said diaphragm is mounted at a height equivalent to a maximum desired liquid level in said separating chamber.

3. The suction apparatus according to claim 2, wherein said diaphragm is positioned in a vertical plane adjacent to a wall of said separating chamber.

4. The suction apparatus according to claim 2, wherein said separating chamber includes a closeable opening for emptying of liquid from said separating chamber.

5. The suction apparatus according to claim 1, wherein said diaphragm switch casing is liquid tight and wherein said switch is mounted substantially within said suction chamber.

6. The suction apparatus according to claim 1, wherein said suction outlet penetrates said suction chamber above a maximum desired liquid level and wherein said diaphragm is mounted upstream of said suction outlet.

7. The suction apparatus according to claim 1, wherein said diaphragm switch has an adjustable response sensitivity.

8. The suction apparatus according to claim 1, further comprising:

a suction means for sucking the loose material into said suction chamber; and an operating circuit for operating said suction means; wherein said diaphragm switch is connected in said circuit for disconnecting said suction means when the loose material reaches a desired maximum fill level in said suction chamber.

9. The suction apparatus according to claim 1, wherein said diaphragm switch is adjustably mounted at a height selected as a maximum desired fill level.

10. The suction apparatus according to claim 1, wherein said diaphragm is mounted in a horizontal plane parallel to and spaced below said suction outlet so as to constitute a spray protector for said outlet.

11. The suction apparatus according to claim 1, wherein at least one suction inlet is located above a maximum desired fill level.

12. The suction apparatus according to claim 1, further comprising an exhauster unit connected to said suction chamber via said suction outlet and adjacent to and separate from said suction chamber.

13. The suction apparatus according to claim 12, further comprising a base upon which said suction chamber is mounted, wherein said exhauster unit is mounted on said base.

14. The suction apparatus according to claim 12, wherein said exhauster unit comprises an exhauster motor and an exhauster gear-driven by means of said exhauster motor.

15. The suction apparatus according to claim 12, wherein said exhauster unit is directly mounted on said suction chamber as a cover.

16. The suction apparatus according to claim 12, wherein said switch is connected to said exhauster unit to control said exhauster unit.

17. The suction apparatus according to claim 1, further comprising a wet filter mounted in said suction chamber; and a pumping means mounted in said suction chamber for pumping liquid from said suction chamber.

18. A suction apparatus for collecting loose material, comprising:

a suction chamber means into which the loose material is sucked;

a suction inlet means penetrating said suction chamber;

a suction outlet means penetrating said suction chamber; and a diaphragm switch mounted on said suction apparatus with a diaphragm exposed to said suction chamber;

wherein said switch is operated by contact between said diaphragm and the loose material and said switch comprises a switch casing and a pressure compensating line leading from inside said switch casing to a portion of said suction chamber above a maximum desired material level; wherein said suction chamber comprises an intermediate ring having connecting flanges for substantially sealed detachable fixing on two remote ends and wherein said switch is mounted on said intermediate ring.

19. The suction apparatus according to claim 18, wherein said intermediate ring is penetrated by at least one suction inlet.

20. The suction apparatus according to claim 18, wherein said intermediate ring has an outside circumference and a connecting plug for at least one switch mounted on said outside circumference substantially on a side remote from said suction inlet.

21. The suction apparatus according to claim 18, wherein said intermediate ring comprises a casing, and wherein said switch is mounted within said casing on a mounting support.

22. The suction apparatus according to claim 21, wherein said mounting support comprises arms attached radially to said intermediate ring.

23. The suction apparatus according to claim 18, wherein one of said connecting flanges is a lower connecting flange, and wherein said switch is suspended substantially below said lower connecting flange.

24. The suction apparatus according to claim 18, wherein said suction chamber and said intermediate ring have cross-sectional shapes substantially identical.

25. The suction apparatus according to claim 18, wherein said connecting flanges are substantially identical.

26. The suction apparatus according to claim 18, wherein said suction chamber comprises a main container, and wherein one of said connecting flanges connects to an upper edge of said main container.

27. The suction apparatus according to claim 18, wherein said suction chamber comprises a filter housing, and wherein one of said connecting flanges connects to said filter housing.

28. The suction apparatus according to claim 18, further comprising a suction means for sucking the loose material into said suction chamber, wherein one of said connecting flanges connects to said suction means.

* * * * *

UNITED STATES PATENT AND TRADEMARK OFFICE

CERTIFICATE OF CORRECTION

PATENT NO. : 4,976,850

DATED : December 11, 1990

INVENTOR(S) : Guenter Kulitz

It is certified that error appears in the above-identified patent and that said Letters Patent is hereby corrected as shown below:

Col. 10, line 10, "scres" should be "screws".

Col. 11, line 64, following 13b, insert "of".

Col. 13, line 2, "T-shpaed" should read "T-shaped".

Signed and Sealed this

Sixth Day of October, 1992

*Attest:*

DOUGLAS B. COMER

*Attesting Officer*

*Acting Commissioner of Patents and Trademarks*